United States Patent [19]

Harrison et al.

[11] 3,987,639

[45] Oct. 26, 1976

[54] METHODS AND APPARATUS FOR INSTALLING A DRILL CONDUCTOR FROM AN OFFSHORE TOWER

[75] Inventors: Douglas S. Harrison, Horley Surrey, England; Albert M. Koehler, Houston, Tex.

[73] Assignee: Brown & Root, Inc., Houston, Tex.

[22] Filed: June 26, 1975

[21] Appl. No.: 590,403

[52] U.S. Cl. ..... 61/86; 166/0.5; 175/9

[51] Int. Cl.[2] ..... E21B 7/04; L21B 15/02

[58] Field of Search ..... 61/46, 46.5; 175/8, 175/9; 166/0.5; 72/369

[56] References Cited

UNITED STATES PATENTS

| | | | |
|---|---|---|---|
| 3,451,493 | 6/1969 | Storm | 175/9 |
| 3,546,889 | 12/1970 | Hemphill et al. | 61/46 |
| 3,592,013 | 7/1971 | Poganowski | 61/46.5 |
| 3,670,507 | 6/1972 | Mott et al. | 175/9 |
| 3,685,300 | 8/1972 | Mott et al. | 61/46.5 |
| 3,687,204 | 8/1972 | Marshall et al. | 175/9 |
| 3,899,032 | 8/1975 | Rees et al. | 175/9 |

*Primary Examiner*—Paul R. Gilliam
*Assistant Examiner*—Alex Grosz
*Attorney, Agent, or Firm*—James E. Cockfield

[57] ABSTRACT

A drill conductor is installed into a water bed from an offshore tower situated in a body of water by lowering the conductor from a deck portion of the tower along a straight path which is inclined relative to vertical until the bottom end of the conductor reaches a predetermined depth in the water bed. The conductor is then bent about a fulcrum to displace an upper segment thereof to a vertically straight posture while maintaining a lower segment thereof above the water bed in a straight and inclined posture. A special arrangement of apertured guides is provided along the tower to accommodate the initial inclinedly straight insertion of the conductor and to accommodate the subsequent displacement of the upper conductor segment. The guides thus support the conductor such that a portion of the conductor disposed above the water bed includes upper and lower straight segments, the upper segment being vertically disposed and the lower segment being inclined relative to vertical.

6 Claims, 12 Drawing Figures

METHODS AND APPARATUS FOR INSTALLING A DRILL CONDUCTOR FROM AN OFFSHORE TOWER

BACKGROUND AND OBJECTS OF THE INVENTION

The present invention relates to the installation of elongate conduits into a submerged earth formation from an offshore tower.

The recovery of fluids, such as oil, from offshore subterranean formations typically involves establishing a plurality of offshore wells which extend into the water bed from a tower situated in the body of water. Normally each well is constructed by driving an elongate drill conductor into the water bed, clearing the conductor interior of mud, then inserting a drill string through the conductor and drilling the well. This technique has been progressively improved with a view toward enabling a plurality of wells to emanate from a single offshore tower and attain as wide a lateral reach into the oil formation as possible. In this fashion, oil exploration and recovery operations are maximized.

Previously proposed efforts toward this end involved linearly installing the conductors at an angle relative to vertical and conducting the drilling operations by means of a slant drilling rig. (See for example, Storm U.S. Pat. No. 3,451,493.) While such an arrangement would provide conductors projecting beyond the perimeter of the tower and thus extend the lateral reach of the drill strings, the required slant drilling rigs are relatively expensive and difficult to operate.

Relatively recent proposals have been made in which it is envisioned that a conductor be installed from a tower deck by initially lowering the conduit vertically downwardly and then gradually curving the conductor outwardly and downwardly through the tower as it approaches the floor of the water body. It has been suggested to accomplish this by progressively urging the conduit through a series of guides which deflect the conductor into a curved configuration (e.g., see Mott et al. U.S Pat. No. 3,670,507 — June 20, 1972). Another suggestion involves plastically performing the conductor before or during installation so that the conductor is urged through the guides in a curved profile (e.g., see Marshall et al. U.S. Pat. No. 3,687,204 — Aug. 29, 1972. Both of these suggestions involve urging a conductor downwardly through a series of guides while in a curved posture. As will be appreciated, such a procedure is accompanied by substantial resistance. This resistance must be dealt with during the entire period of descent of the conductor, which is often driven hundreds of feet into the water bed.

It would be desirable to install a conductor into the water bed to achieve a wide lateral reach while encountering less resistance and without requiring the subsequent use of a slant drilling rig.

It is therefore an object of the present invention to obviate or minimize problems such as those discussed previously.

It is also a major object of the invention to provide conductors with straight line exit paths which tend to effectively control directions of deviated drilling.

It is a further object of the invention to provide methods for installing a conductor with minimum resistance to achieve a wide lateral reach, and without requiring the subsequent use of a slant drilling rig.

It is yet another object to provide such methods wherein a portion of the conductor situated above the water bed includes an upper segment oriented in a vertically straight posture and a lower segment oriented in an inclinedly straight posture.

It is a further object of the invention to provide such methods wherein the conductor is initially installed along a straight path inclined relative to vertical, and the upper conductor segment is subsequently bent about a fulcrum to assume a vertically straight posture.

It is still a further object of the invention to provide an apparatus for supporting a conductor from an offshore tower such that the upper conductor segment is oriented in a vertically straight posture and the lower conductor segment is oriented in an inclinedly straight posture.

It is still another object of the invention to provide such an apparatus wherein the conductor is supported in guide apertures of different cross-sections, with one of the guide apertures defining a fulcrum about which the conductor is bent.

BRIEF DESCRIPTION OF A PREFERRED EMBODIMENT OF THE INVENTION

These and other objects are achieved by the present invention wherein a conductor is lowered from a deck portion of an offshore tower along a straight path which is inclined relative to vertical. The conductor is lowered in this posture until the bottom end of the conductor reaches a predetermined depth in the water bed. The conductor is then bent about a fulcrum to displace an upper segment of the conductor to a vertically straight posture while maintaining a lower segment of the conductor above the water bed in a straight and inclined posture.

The conductor is lowered through a plurality of apertured guides. At least the uppermost one of the guides has a cross section that is greater than that of the conductor. Another of the guides constitutes the fulcrum about which the conductor is bent such that the upper conductor segment shifts within the guide aperture of greater cross section.

The guides are vertically and horizontally spaced along the tower, with their apertures being aligned along an inclinedly straight path which coincides with the inclinedly straight path of conductor installation. The guides support the conductor such that a portion of the installed conductor situated above the bed of the body of water includes an upper segment oriented in a vertically straight posture and a lower segment oriented in a straight posture inclined relative to vertical.

THE DRAWINGS

Other objects and advantages of the present invention will become apparent from the subsequent detailed description thereof in connection with the accompanying drawing in which like numerals designate like elements and in which.

DETAILED DESCRIPTION OF THE PREFERRED EMBODIMENT

Figure 1:
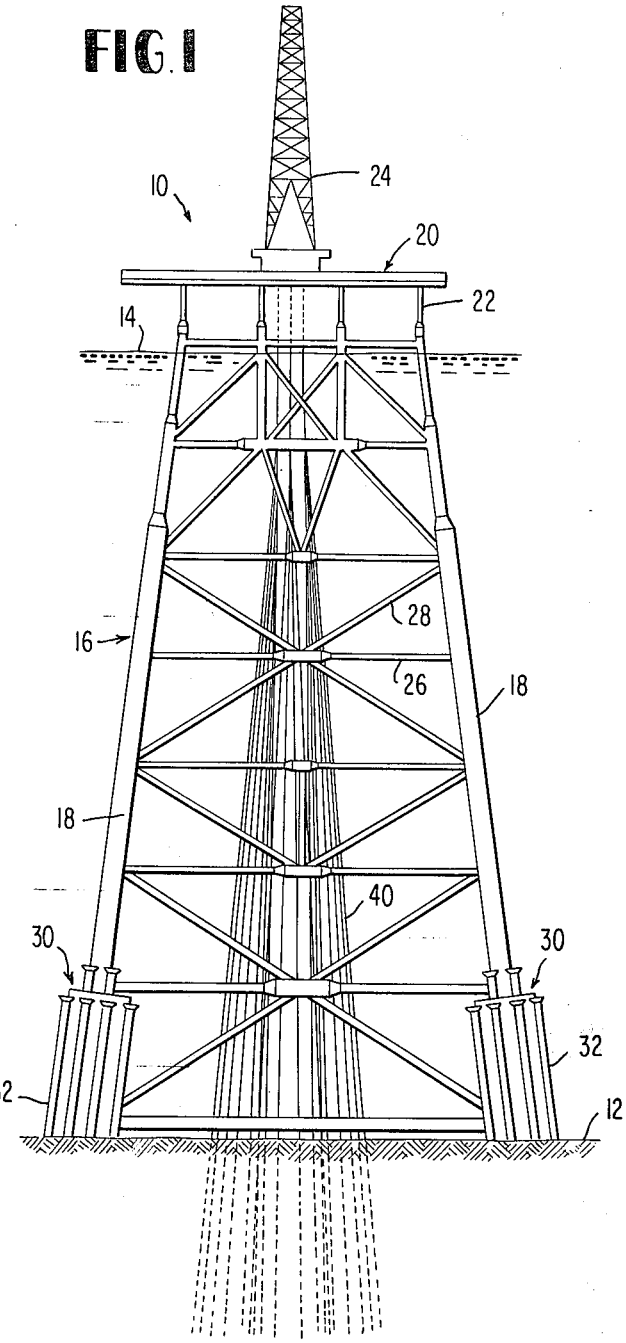
FIG. 1 is a side elevational view depicting a fixed offshore tower with a plurality of drill conductors extending therefrom into the water bed.

Referring now to the drawings, and more particularly to FIG. 1, a steel tower 10 is illustrated in an upright erected posture on the bed 12 of a body of water 14. The tower includes a support frame structure 16 comprising a plurality of generally upright supporting columns or legs 18 which typically slope inwardly and upwardly. The legs are axially dimensioned to extend between the water bed, or submerged earth formation, and the water surface for supporting an operating platform or deck 20 above the water surface.

The platform 20 is connected to the tower legs 18 by means of generally vertical riser columns 22, which ensure that the platform is sufficiently elevated above the water surface.

The platform is typically provided with one or more drilling rigs 24 and other equipment suitable for sustaining continuous oil-drilling operations.

To support the significant loading created by the platform, the supporting legs are laterally and vertically stabilized by a plurality of transverse and diagonal struts 26, 28. The cross-sectional size of the tower legs 18 increases in a downward direction to compensate for the progressively increasing load which must be sustained.

At the base of the legs 18, anchoring assemblies 30 are provided. Such anchoring assemblies typically include a series of hollow steel piling jackets 32 which are dimensioned to receive anchor pilings that are installed into the submerged earth formation to pin the tower 10 thereto.

In order to remove subterranean fluid, such as oil or gas, from the submerged earth formation, a plurality of wells are drilled from the tower 10. To effect this, a plurality of conductors 40 are installed into the submerged earth formation 12 from the deck 20 of the tower 10. In order to maximize the lateral reach of the conductor pattern, and to enable deviated wells to be more easily directed towards their target, most of the conductors 40 are oriented to enter the submerged earth formation at an angle relative to vertical.

Such inclined conductors 40 are inserted hundreds of feet into the submerged earth formation 14 such that bottom ends of the conductors are located outside of the periphery of the tower 10.

Figure 5:
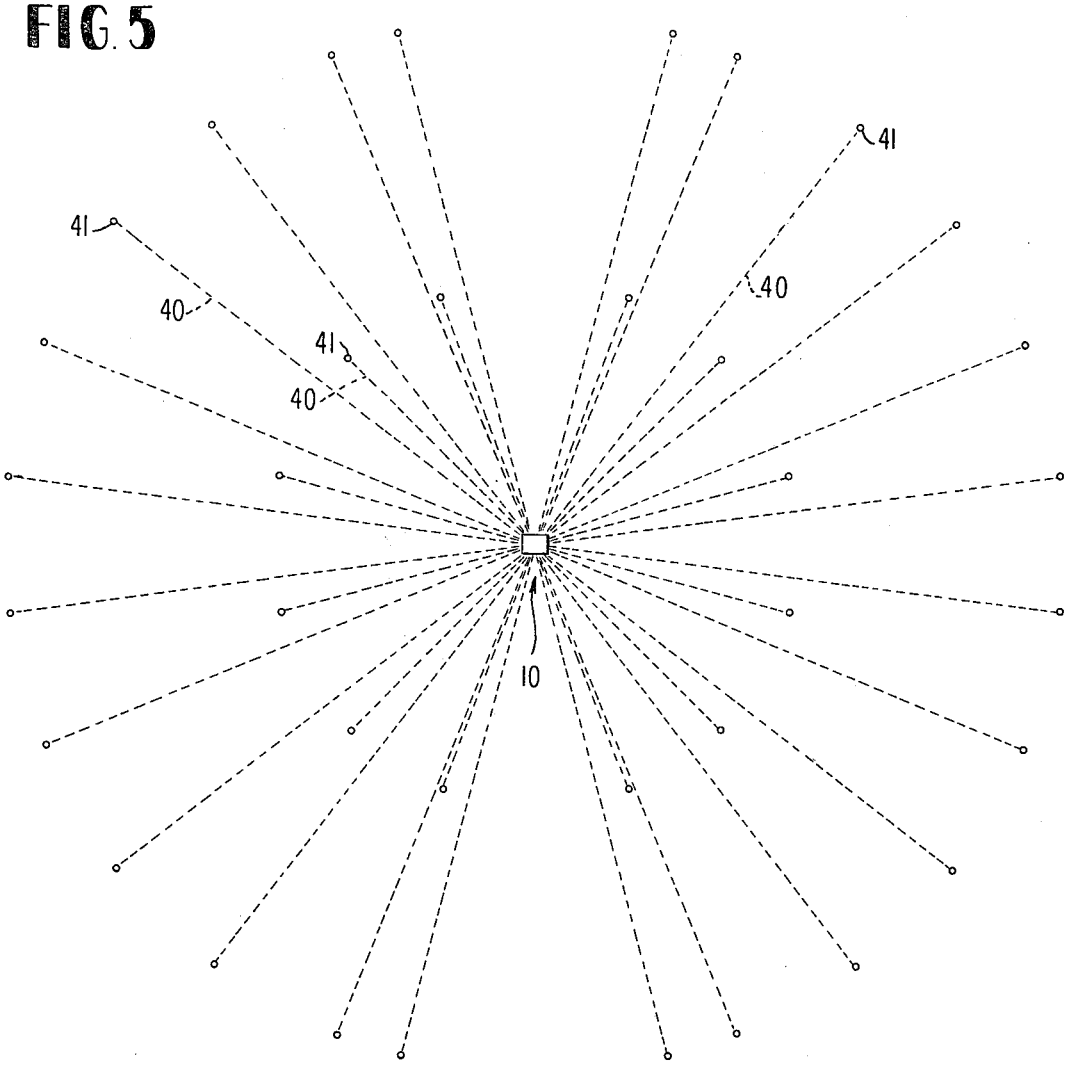
FIG. 5 is a schematic representation depicting, in plan, the pattern of installed conductors relative to the offshore tower.

Attention is directed to FIG. 5 which schematically depicts the conductor pattern as emanating downwardly and outwardly from the tower and terminating at locations 41 disposed considerably outwardly of the tower perimeter. It is anticipated in connection with certain oil-drilling operations that the completed wells will extend to depths of, for example, 7400 feet below water level with a lateral reach of 7000 feet from the vertical tower axis. Subsequently, production tubing is inserted in the wells in a conventional manner and oil is conducted from the producing horizon to the deck of the tower. Conventional well-head equipment is disposed at the upper ends of the conductors to regulate and control the removal of oil.

As noted previously, it would be desirable to facilitate the installation of the conductors 40 by minimizing the resistance to downward movement of the conductors. At the same time, it would be advantageous to conduct drilling operations, commencing the deviated holes from an already angled start, and with upright drilling rigs rather than slant-type drilling rigs.

In accordance with the present invention, and as will be discussed in more detail subsequently, a plurality of conductors are lowered from the deck along straight or linear paths that are inclined relative to vertical. Such lowering procedure is continued until the bottom ends of the conductors reach predetermined depths in the submerged earth formation. By installing the conductor in a straight posture, all driving forces imposed on the conductor are directed co-linearly with the path of conductor descent to maximize installation efficiency. This is achieved without the high resistance that would be encountered if the conductor were installed along a curved path.

Figure 11:
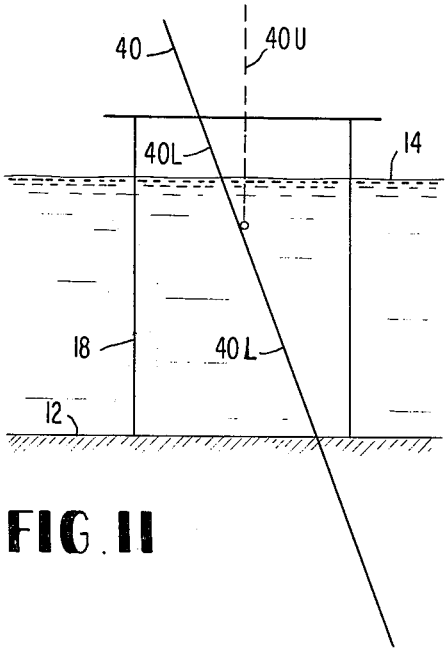
FIG. 11 is a side elevational schematic view of an offshore tower depicting various stages of installing a conductor into the water bed.

With this accomplished, a portion of the conductor extends from the deck 20 to the water bed 12 (FIG. 11). The upper segment 40U of this conductor portion is then displaced to a vertically straight posture (see the broken line depiction in FIG. 11) by bending the conductor about a fulcrum disposed between the deck 20 and the water bed 12. This is effected while maintaining the lower segment 40L of the conductor portion in an inclinedly straight posture. Since the upper conductor segment is finally oriented in a vertically straight posture, drilling operations can be conducted with a conventional drilling rig.

More particularly, the conductors 40 are each installed by being passed through a set of guides 42. The guides 42 are apertured to define, between the deck 20 and the water bed 12, an essentially straight guide path which is inclined relative to vertical.

Figure 2:
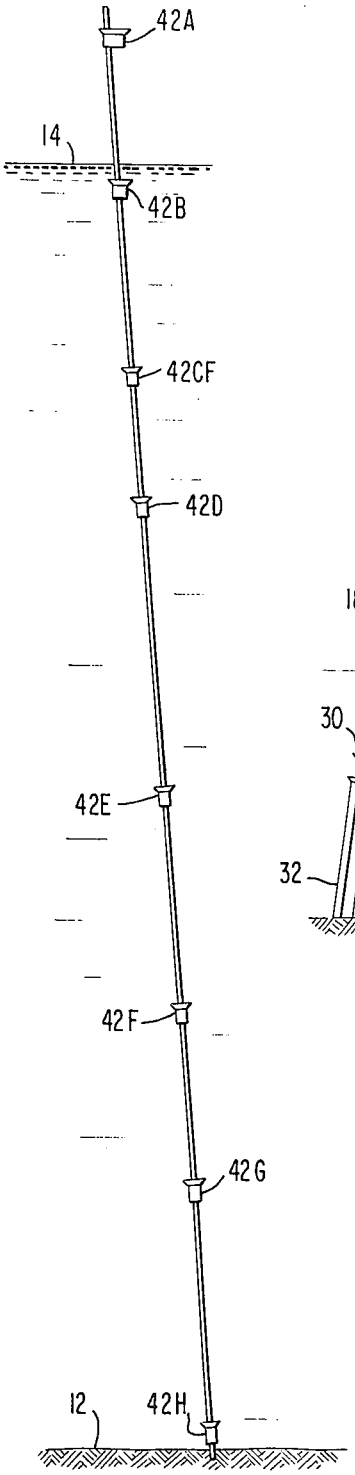
FIG. 2 is a side elevational schematic illustration of a conductor as it is being installed into the water bed.
Figure 3:
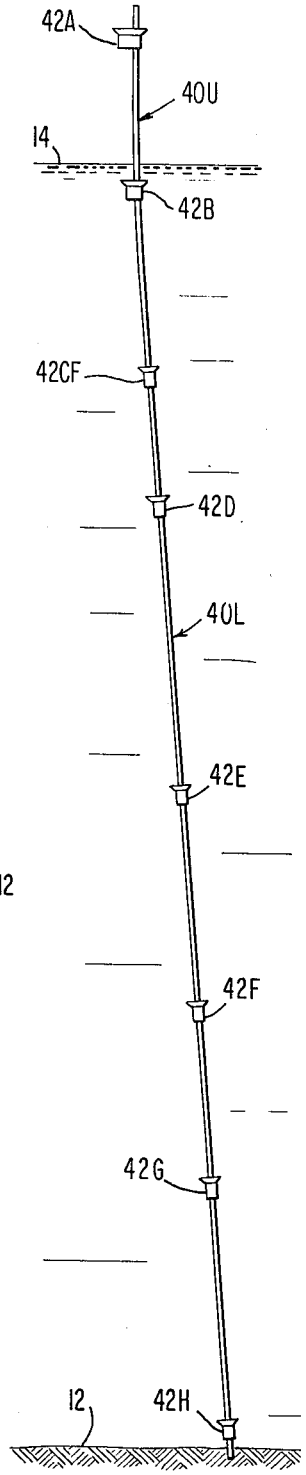
FIG. 3 is a side elevational schematic view depicting a conductor after being bent into its drilling posture.
Figure 4:
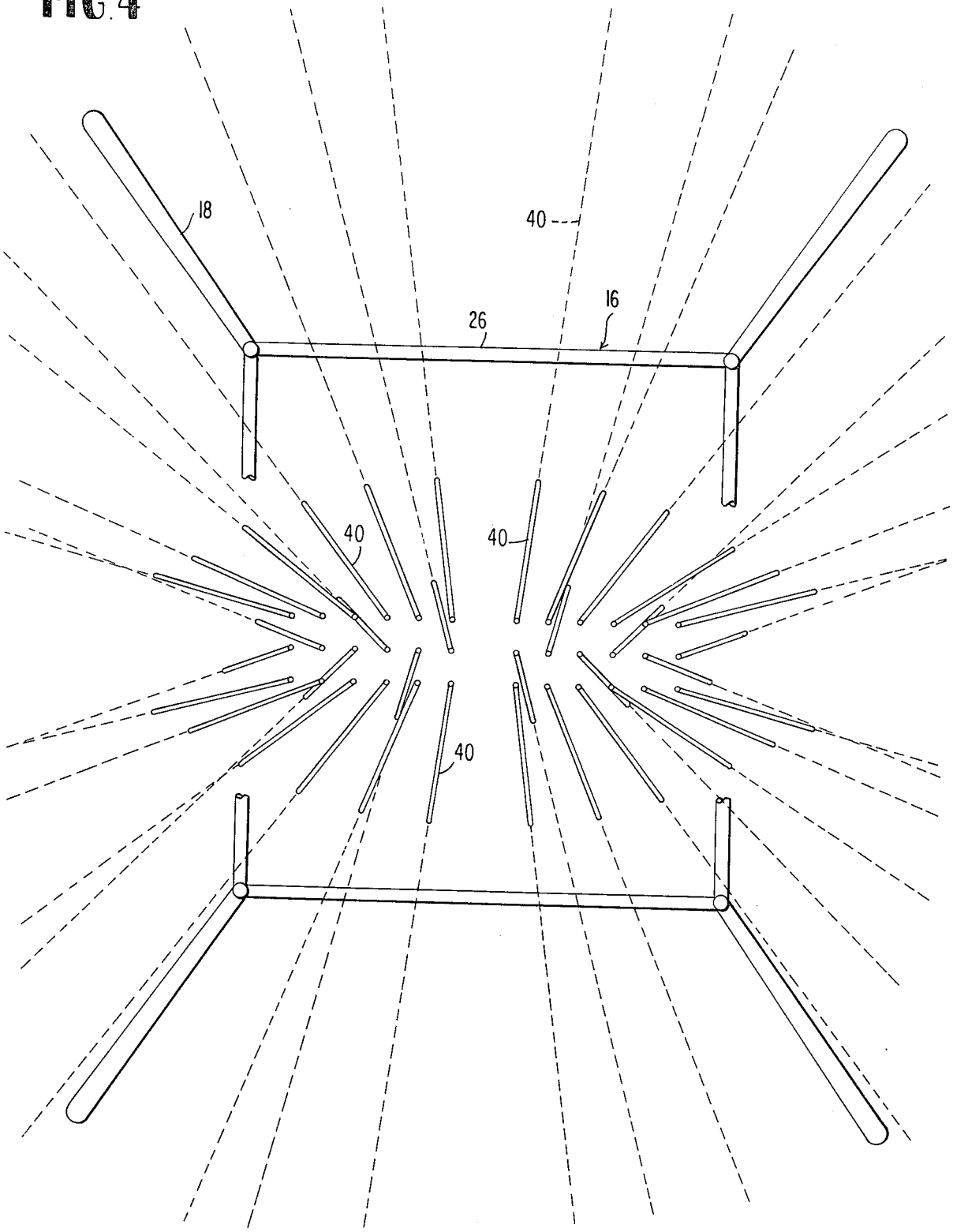
FIG. 4 is a schematic plan representation depicting the pattern of installed conductors relative to the offshore tower.

Such an arrangement is shown somewhat schematically in FIG. 2 wherein apertured guides 42A–H are arranged in vertically and horizontally spaced relationship along the tower height. These guides 42 each include a guide aperture 44 through which the conductor extends.

Figure 7:
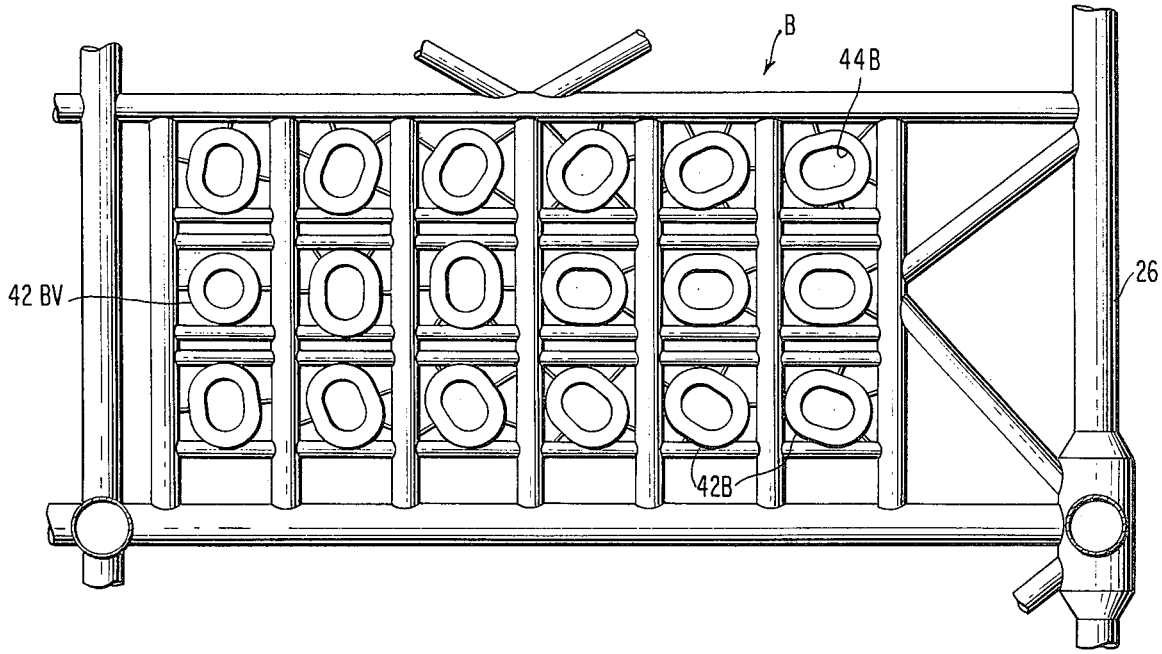
FIG. 7 is a partial plan view of a group of apertured guides disposed below the group depicted in FIG. 6.
Figure 10:
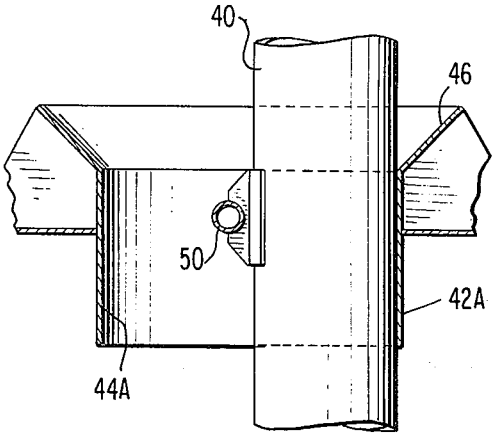
FIG. 10 is a vertical sectional view of the apertured guide depicted in FIG. 9.

One of the guides 42A is located above the water surface and has a guide aperture 44A whose cross-sectional area is greater than that of the conductor 40. Preferably the guide aperture 44A is of oblong or eliptical shape (FIGS. 7 and 10).

The guide 42B, disposed immediately therebelow, is disposed below water level and has a guide aperture 44B which is also of generally oblong configuration (see FIG. 8). The length of the guide aperture 44B is less than that of aperture 44A, since the amount of linear displacement of the conductor through the aperture 44B (to occur later) will be less than its displacement through the aperture 44A.

Figure 12:
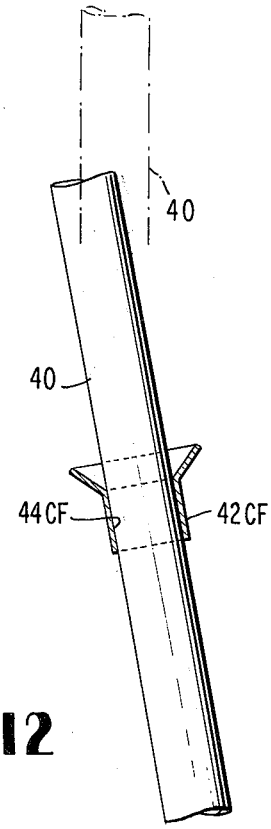
FIG. 12 is a longitudinal sectional view of an apertured guide which defines a fulcrum for bending a conductor.

The next guide 42CF has a guide aperture 44CF which is essentially circular, with a diameter essentially the same as the diameter of the conductor (see FIG. 12). This guide 42CF represents a fulcrum about which the upper conductor section is to be bent to a more nearly, or even truly vertically straight posture, as discussed previously. It will be appreciated that as the upper conductor segment 40U is being laterally displaced, it shifts within the oblong guide aperture 44A from the left side of this guide aperture to the position of FIG. 10. A similar shifting occurs within the guide aperture 44B.

Thus, it will be appreciated that the guide apertures 44A, B are large enough to accommodate passage of the associated conductor along an initial linear, inclined path of installation as well as accommodate lateral shifting movement of the upper conductor section to a vertical posture. That is, a straight line could be drawn through the apertures 44A–H along the inclinedly straight path of conductor descent. The guide aperture 44CF is preferably inclined relative to vertical in accordance with the intended inclination of its associated conductor 40.

The remaining conductors 42D–H disposed below the fulcrum conductor 42CF are similar to the conductor 42CF in that they have guide apertures which are of essentially the same diameter as that of their associated conductor and are aligned and inclined in accordance with the intended inclination of their associated conductor.

Figure 6:
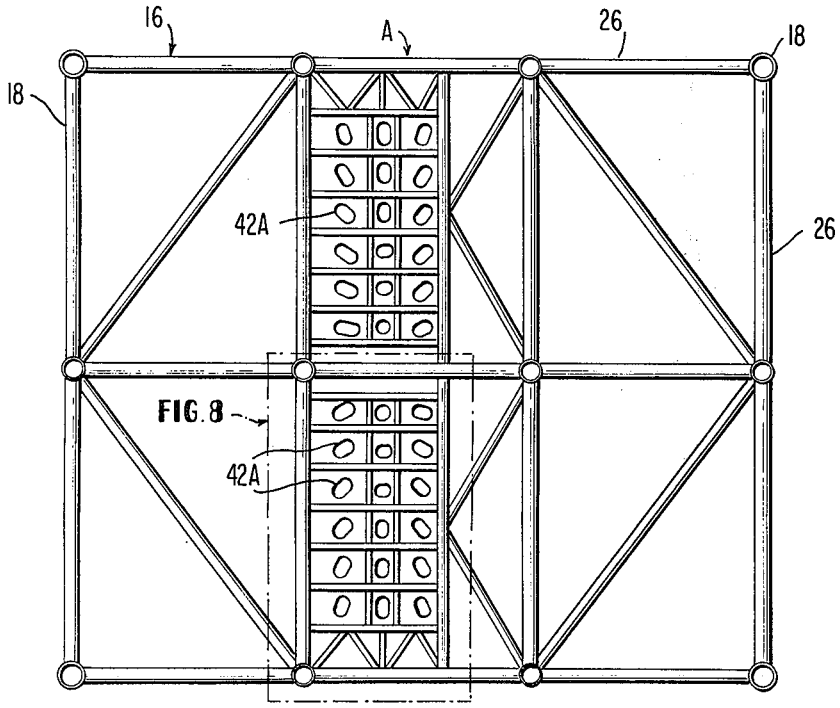
FIG. 6 is a plan view of a group of apertured guides which support upper segments of the conductors.

In order to support the conductors along the height of the tower 10, the guides 42A–H are arranged in vertically spaced groups A–H. That is, the guides 42A are connected as a group A to transverse braces 26 of the tower 10 (see FIG. 6). The relative orientation of the guide apertures 44A is depicted in FIG. 7, reflecting the differently oriented paths through which the conductors extend into the water bed.

Figure 8:
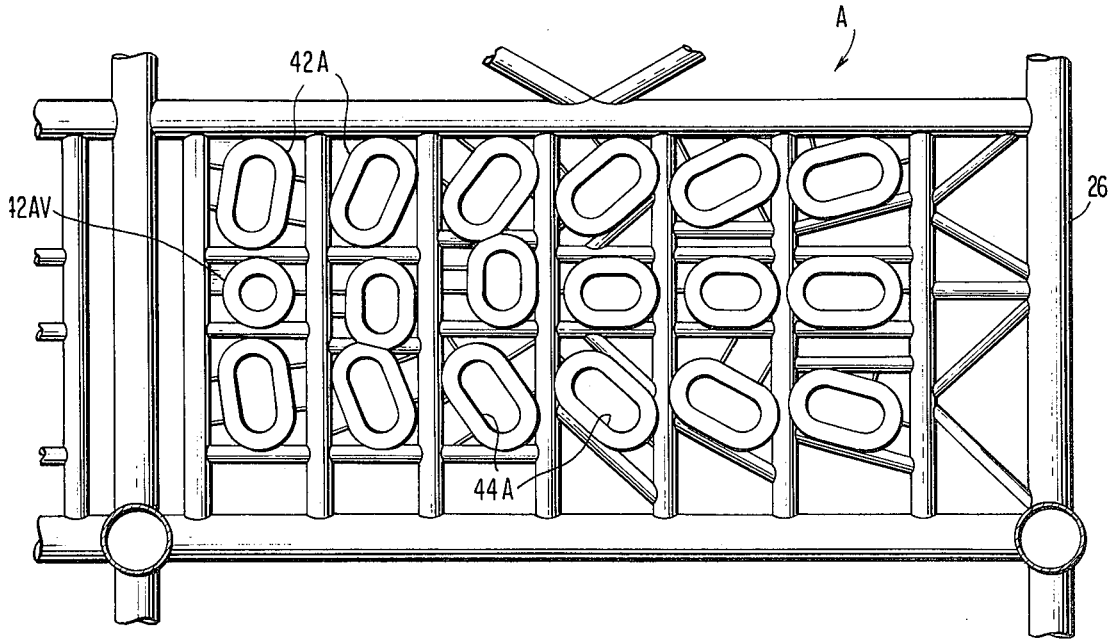
FIG. 8 is a partial plan view of the group of apertured guides depicted in FIG. 6.

FIG. 8 depicts the guides 42B of Group B and their relative orientation. It will be realized, of course, that the guide apertures 44B extend parallel to the guide apertures 44A disposed thereabove to assure proper displacement of the upper conductor sections.

Each guide 42 preferably includes a funnel-shaped flange 46 (FIGS. 9–10) which defines a conductor-receiving zone that is somewhat larger than the associated guide aperture. In this fashion, initial installation of the conductors through the guide is facilitated.

It will be appreciated that the conductors 40 are inclined relative to one another, with preferably one or more of the conductors being installed in a vertical posture. Such vertical conductors are, of course, installed through circular guide apertures and do not require bending about a fulcrum. In this connection, note the guides 42AV, 42BV in FIGS. 7 and 8 which receive and support a vertically installed conductor.

The displacement of the upper conductor segments 40U to a vertically linear posture is preferably accomplished by means of a winch, wherein a cable extending around the conductor is actuated to displace this upper conduit segment about the fulcrum.

Once the conductor has been oriented with its upper segment 40U positioned vertically straight and its lower segment 40L positioned inclinedly straight, a bracing fixture in the form of a bar 50 (FIGS. 9–10) can be welded within the guide 42A behind the conductor to constrain the upper conductor segment in its vertical posture.

It should be noted that the bending of the conductors 40 around the fulcrum guides 42CF is accomplished without exceeding the elastic bending limit of the steel conductor. Thus, no substantial weakening of the conductor results from such bending.

CONDUCTOR INSTALLATION

Figure 9:
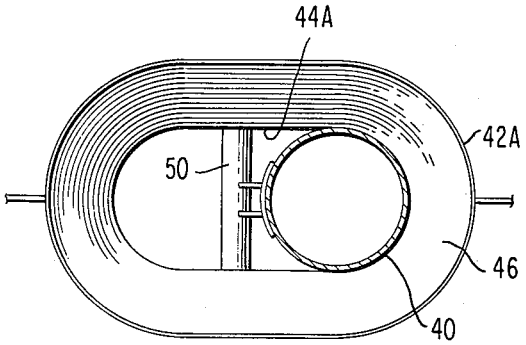
FIG. 9 is a plan view of an apertured guide depicted in FIG. 8 with a vertical conductor segment disposed therein.

To install a conductor 40 into the submerged earth formation 14 from the deck 20, the guides 42A–H associated therewith are oriented to define a suitably straight and inclined guide path for the conductor. The conductor is lowered through an enlarged opening in the deck 20 and within the guide apertures so as to be disposed in an inclinedly straight posture. The conductor preferably comprises a series of comparatively thick wall steel tubular sections which are welded together during installation. Upon reaching the water bed the conductor is urged to a proper depth within the submerged earth formation. Conventional hammering or pile-driving apparatus may be utilized to drive the conductor through the earth. A cable is then attached to the upper segment 40U of the conduit and is winch-actuated to displace the upper conductor section from its inclined position to a vertical position, the bracing fixture 50 is rigidly installed within the guide aperture 42A to establish a permanent support for the conductor (FIGS. 9 and 10).

If desired, all of the conductors may be installed into the submerged earth formation before the upper segments thereof are displaced to a vertically straight posture.

With the exception of the conductor that is installed vertically within the earth formation, the conductors are disposed such that their upper segments 40U are oriented vertically straight and their lower segments 40L above the water bed are oriented inclinedly straight.

Eventually, a suitable drilling rig apparatus 24 is installed to commence the drilling phase of operations, a drilling string is inserted through one of the conductors, and the drilling of the well is commenced with the drill string already angled in the direction which it will finally bottom in the producing horizon.

SUMMARY OF MAJOR ADVANTAGES AND SCOPE OF THE INVENTION

The present invention enables a conductor to be installed within a submerged earth formation along a straight path inclined relative to vertical. As a result, much less resistance is encountered as would be the case if the conductor were installed in a curved posture through fixed guides. In performing the present invention, the forces that are applied to the conductor during installation are aligned with the direction of installation and thus are more efficiently utilized. Since the upper conductor segments are displaced to a vertical posture, drilling operations can be carried out with conventional drilling rigs so as to minimize time and expense involved in drilling.

A significant advantage of the invention resides in the manner in which the conductor is initially installed in a linear or straight line form and thereafter manipulated so as to provide a straight line entry path for a drill string and a straight line exit path, oriented in a desired deviation direction in order to effect deviated or slant drilling. The orientation of the exit path in this manner is believed to be particularly advantageous intending to ensure that drill strings leave conductors, oriented in the right direction, thereby enhancing the likelihood of drilling continuing in the right or desired deviated direction.

As will thus be appreciated, the present invention departs markedly and significantly from the concepts disclosed in the aforesaid Mott et al. U.S. Pat. No. 3,670,507 and the aforesaid Marshall et al. patent, both of which contemplate curved exit configurations for conductors in the installation of conductors at the outset through a curved guide path.

For purposes of ease of discussion, the invention has been described in the context of an arrangement where the conductor guide 42CF would function as the prine fulcrum in order to enable a conductor to be bent from a deviated into an upright or vertical configuration. As will be appreciated such an arrangement would contemplate a degree of bending which would neither overstress the conductor pipe nor provide a degree of bending which would be excessive so as to unnecessarily interfere with the passage of the drill string during drilling operations. (However, for convenience of presentation, drawings such as FIGS. 11 and 12 have been exaggerated with respect to the degree of deviation so as to more clearly illustrate the concepts being discussed).

As will be apparent, the desired degree of reorientation of the drill pipe could be effected with several conductor guides providing a degree of fulcrum action, i.e., partial bending toward an upright orientation could be effected at each of the conductor guides 42CF and 42B, as well as at other stations.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A method of installing a plurality of conductors into a water bed from a tower situated in a body of water comprising the steps of:

lowering at least one of said conductors from a deck portion of said tower along a straight path inclined relative to vertical until said conductor is embedded in said water bed;

said lowering of said conductor being effected by passing said conductor downwardly through a series of vertically spaced guides, with said guides being operable to permit subsequent bending of an upper portion of said conductor between at least two of said guides;

bending an upper portion of said conductor about a fulcrum to displace an upper segment of said conductor to a vertically straight posture while maintaining a lower segment of said conductor above the water bed in a straight and inclined posture;

said bending of said upper portion of said conductor being effected after said conductor has been embedded in said water bed; and maintaining said lower portion of said conductor substantially unbent and straight.

2. A method according to claim 1 wherein said lowering step includes the step of extending said conductor through linearly aligned apertures of said guides, with said guides comprising plurality of vertically and horizontally spaced guides connected to said tower.

3. A method according to claim 2 wherein said extending step includes the step of extending said conductor through a plurality of apertured guides, at least the uppermost one of said guides having a cross section that is greater than that of said conductor; and said bending step includes the step of displacing said upper conductor section about a fulcrum defined by another of said guides such that said upper conductor section shifts within said guide aperture of greater cross section.

4. A method according to claim 3 including the step of inserting fixture means within said guide aperture of greater cross section subsequent to said displacing step, to retain said upper conductor segment in a substantially vertically straight posture.

5. A method according to claim 3 wherein said bending step includes the step of displacing said upper conductor segment about a fulcrum defined by one of said guides having a guide aperture of a cross-sectional are substantially equal to that of said conductor.

6. A method of installing a plurality of drill conductors into a water bed from a tower situated in a body of water comprising the steps of:

lowering at least one of said conductors into said body of water from a deck portion of said tower along a straight path inclined relative to vertical until said conductor is embedded in said water bed;

said lowering of said conductor being effected by passing said conductor downwardly through a series of vertically spaced guides, with said guides being operable to permit subsequent bending of an upper portion of said conductor between at least two of said guides;

passing said conductor through at least one upper guide having an aperture of a cross-sectional size greater than that of said conductor;

passing said conductor through a plurality of lower guides situated below said at least one initial guide, said lower guides being vertically and horizontally spaced and each having an aperture of a cross-sectional size substantially the same as that of said conductor;

elastically bending said conductor about a fulcrum defined by an uppermost one of said lower guides to displace an upper segment of a portion of said conductor situated above said water bed to a vertically straight posture while maintaining a lower segment of said conductor portion in an inclined straight posture;

said bending of said upper portion of said conductor being effected after said conductor has been embedded in said water bed; and maintaining said lower portion of said conductor substantially unbent and straight.

* * * * *